United States Patent [19]

Bertoli et al.

[11] Patent Number: 4,590,753

[45] Date of Patent: May 27, 1986

[54] PROCEDURE FOR THE MECHANICAL SPLICING OF TEXTILE YARNS

[75] Inventors: Luciano Bertoli, Salo' ; Roberto Badiali; Claudio Speranzin, both of Pordenone, all of Italy

[73] Assignee: Officine Savio S.p.A., Pordenone, Italy

[21] Appl. No.: 637,570

[22] Filed: Aug. 3, 1984

[30] Foreign Application Priority Data

Aug. 5, 1983 [IT] Italy ..... 83443 A/83

[51] Int. Cl.[4] ..... B65H 69/06; D01H 15/00

[52] U.S. Cl. ..... 57/22; 57/202

[58] Field of Search ..... 57/22, 23, 261, 262, 57/202

[56] References Cited

U.S. PATENT DOCUMENTS 3,307,339 3/1967 Porter ..... 57/22

4,406,115 9/1983 Necaty-Hindi et al. ..... 57/22

4,407,117 10/1983 Galsworthy ..... 57/22

*Primary Examiner*—John Petrakes

*Attorney, Agent, or Firm*—Wegner & Bretschneider

[57] ABSTRACT

Improvements to procedures for the splicing of yarns (20-21), whether textile or not, the splice being obtained by coupling two single untwisted yarns (20-21) and re-imparting the twists thereafter, in which improvements a part of the single yarns is untwisted until twists of a sign opposite to the original sign have been imparted, and such part is then coupled and small tails (220-221) are obtained, and the coupled segment is then retwisted by imparting a desired twist, such small tails (220-221) being obtained after a substantial parallelization of the fibres to be plucked and/or torn (42) and after a successive plucking and/or tearing action (40) along the axis of the yarns, the tapering (320-321) of such tails (220-221) reaching the neighborhood of the periphery of the retwisting rings (28), the resulting tails (220-221) being controlled and positioned alongside the yarns (21-20) before the beginning of such action to impart such desired retwisting, at least part of the segment of yarn being untwisted undergoing a drawing action at least during the untwisting step and at least at about the transient stage of conversion from one type of twist to the other (from "Z" to "S" or from "S" to "Z").

23 Claims, 16 Drawing Figures

PROCEDURE FOR THE MECHANICAL SPLICING OF TEXTILE YARNS

This invention concerns improvements in the mechanical splicing of textile yarns and also concerns a device that employs such improvements.

According to the invention the improvements relate to the untwisting step at least at the transient moment of changing from a "Z" twist to an "S" twist or viceversa.

A procedure in the name of CSIRO is known and envisages the untwisting of two textile yarns by keeping under control the segment to be untwisted, then coupling the untwisted segments and retwisting the segments thus coupled while still keeping them controlled.

Improvements to such procedure are known as also are various devices which employ such improvements in the name of the present assignee, by which the orginal CSIRO procedure has been improved so as to obtain a more and more perfect mechanical splice of textile yarns which is more and more like, and therefore more and more likely to be confused with, the basic yarn with which the splice is made, thus enabling a splice to be obtained which is almost invisible in the yarn itself.

The present improvements tend to create a further improvement in the splice obtained with the CSIRO procedure as improved by the present assignee, the purpose being to obtain many advantages which can still not be reached with the improvements so far applied to the known procedure.

The improvements therefore tend to obtain a more and more perfect and better splice so as to embody a splice absolutely suitable for tending to become invisible in effect within the basic yarn of which the splice is formed.

The improvements therefore tend to obtain a set of advantages which can be summarized as follows.

They enable the quantity of fibers in the splice and also the final diameter of the splice to be reduced.

They permit the quantity of fibers in the splice to be controlled and graduated as required and thus enable the final diameter of the splice thus obtained to be controlled and graduated as required.

They enable the ability to apply a device employing such improvements to be extended to cover practically any type of yarn which can be processed so that, given equal dimensions in a device employing such improvements, it is possible to process also longer fibers until the whole range of the textile lengths of fibers is practically covered.

It is possible to recover within the untwisting disks a yarn that tends to become elongated during untwisting, by provoking a twisting of the yarn; this recovery makes it possible to avoid the formation of loops which might cause shortcomings.

The improvements enable an action of substantial combing of the fibers to be created, and this action predisposes the fibers of one yarn to become better amalgamated with those of the other yarn during the retwisting step.

According to a variant of such improvments it is also possible to obtain a splice with a longer and more tapered tail having a desired smaller number of fibers.

It is possible to obtain a splice which in an intermediate phase provides a common zone in which the two yarns remain substantially integral and which has a value comprised between zero (the integral yarns reach the neighborhood of the center line of the splice) and the value of the inner diameter of the retwisting rings or equivalent means.

Owing to the improvements it is also possible to obtain splices which in an intermediate phase comprise yarns having their integral segment contained between the neighborhood of the center line of the splice and the neighborhood of the outer periphery of the retwisting rings or equivalent means.

It is possible to obtain a stronger and more compact final splice without losing thereby the natural resilience of the yarn and without creating hairiness or other unfavourable factors, the yarn being reconstituted in fact according to its mechanical and physical components.

It is known that the procedure for the mechanical splicing of textile yarns envisages the untwisting of the yarns so as to change the twists from "Z" to "S" or viceversa, then the coupling of the untwisted zones in a controlled system and afterwards the retwisting.

This invention concerns procedures for the splicing of yarns, whether textile or not, the splice being obtained by coupling two single untwisted yarns and by reconstituting the twists thereafter, in which procedure a part of the single yarns is untwisted until twists of a sign opposite to the original sign have been imparted, the part is then coupled and tails of yarn are obtained and then the coupled segment is retwisted so as to impart a required twist; such tails of yarn are obtained after making substantially parallel the fibers to be plucked and/or torn and by performing thereafter a substantially axial plucking and/or tearing action; the graduation of the tails reaches almost the neighborhood of the periphery of the retwisting rings, and the tails of yarn are controlled and positioned close to the yarns before the action of imparting the required retwisting is begun.

Moreover, this procedure for the splicing of yarns, whether textile or not, envisages that the fibers in the tail ends of yarn are made parallel by a substantial balancing of the negative and positive twists obtained in the neighborhood of the periphery of the retwisting rings at the end of untwisting and after an at least partial slackening of the untwisting means.

Furthermore, the procedures to splice yarns which are textile yarns or otherwise visualise that the segment of fibres made parallel is determined by grippers which balance twists and by inner clamping means located respectively outside and inside the peripheral circumference of the retwisting rings.

According to the improvements of this invention, at least at about the transient state of the change from "Z" twist to "S" twist or viceversa, both the segments of yarn which have to be coupled undergo a drawing action which can also cause a slight plucking action.

According to a variant such drawing action is also applied during the untwisting action. In this case the drawing action can be constant or variable and, in a variant, can be applied resiliently.

This drawing action can be adjusted advantageously to suit the type of yarn to be spliced so as to be able to obtain a desired plucking action as well.

The plucking action leads to a reduction in the quantity of fibers contained in the untwisted segment and in this way it is possible to control also the quantity of fibers remaining in such untwisted segment.

It is also possible with such plucking action to process longer fibers, given equal untwisting disks, since reciprocal adjustments of the position and quantity of fibres are obtained which enable splices to be produced with longer fibers.

The drawing action also makes possible a recovery, to a required value, of the natural elongation of the yarn taking place in the untwisting step.

Moreover, the possible plucking action creates almost a combing of the fibers and enables them to be better positioned for better amalgamation during the retwisting step after having been coupled.

An evolutionary variant of these improvements serves to obtain a better final splice and arises from the fact that, during the coupling step after the untwisting, the clamping of the segments which do not undergo plucking can be obtained at any point between the neighborhood of the inner periphery of the untwisting rings and the opposite end of the yarn located near the outside of the untwisting ring and located in a substantially diametral position in relation to the aforesaid clamping point.

This, in cooperation with the action of reduction of the fibers obtained at least in the transient state of untwisting, enables a graduation of tail to be obtained which ranges from a value approximately coinciding with the width of the untwisting ring to a value which approximately coincides with the outer diameter of the untwisting ring or equivalent means employed for such purpose.

A central zone can thus be also obtained with a substantially double yarn, the zone being very compacted and limited and therefore almost invisible and not capable of being detected in all textile operations.

Or else it is possible to obtain a splice made by coupling two completely tapered tails of yarn.

Furthermore, the greater length of the tails in conjunction with the action of reduction of the fibers obtained during the transient state of untwisting, makes possible a better amalgamation and a stronger splice which still remains substantially resilient.

The invention is therefore obtained with improvements to procedures for the splicing of yarns, whether textile or not, the splice being obtained by coupling two single untwisted yarns and re-imparting the twists thereafter, in which improvements a part of the single yarns is untwisted until twists of a sign opposite to the original sign have been imparted, and such part is then coupled and small tails are obtained, and the coupled segment is then retwisted by imparting a required twist, such small tails being obtained after a substantial parallelization of the fibers to be plucked and/or torn and after a successive plucking and/or tearing action along the axis of the yarns, the tapering of such tails reaching the neighborhood of the periphery of the retwisting rings, the resulting tails being controlled and positioned alongside the yarns before the beginning of such action to impart such desired retwising, the improvements being characterized by the fact that at least part of the segment of yarns being untwisted undergoes a drawing action at least during the untwisting step and at least at about the transient stage of conversion from one type of twist to the other (from "Z" to "S" or from "S" to "Z").

The invention is also embodied with a splice between yarns, whether textile or not, the splice being characterized by being obtained with the above improvements.

The invention is also embodied with yarns, whether textile or not, characterized by the fact that they contain splices obtained in the manner described above.

Let us now see a preferred solution of the invention with the help of the attached figures, which are given as a non-restrictive example and in which:

FIG. 1 shows a splice according to the invention;

FIGS. 2*a* and *b* show yarns which in this example are positioned parallel in the retwisting means;

Figures 11A, 11B, 11C, 11D:
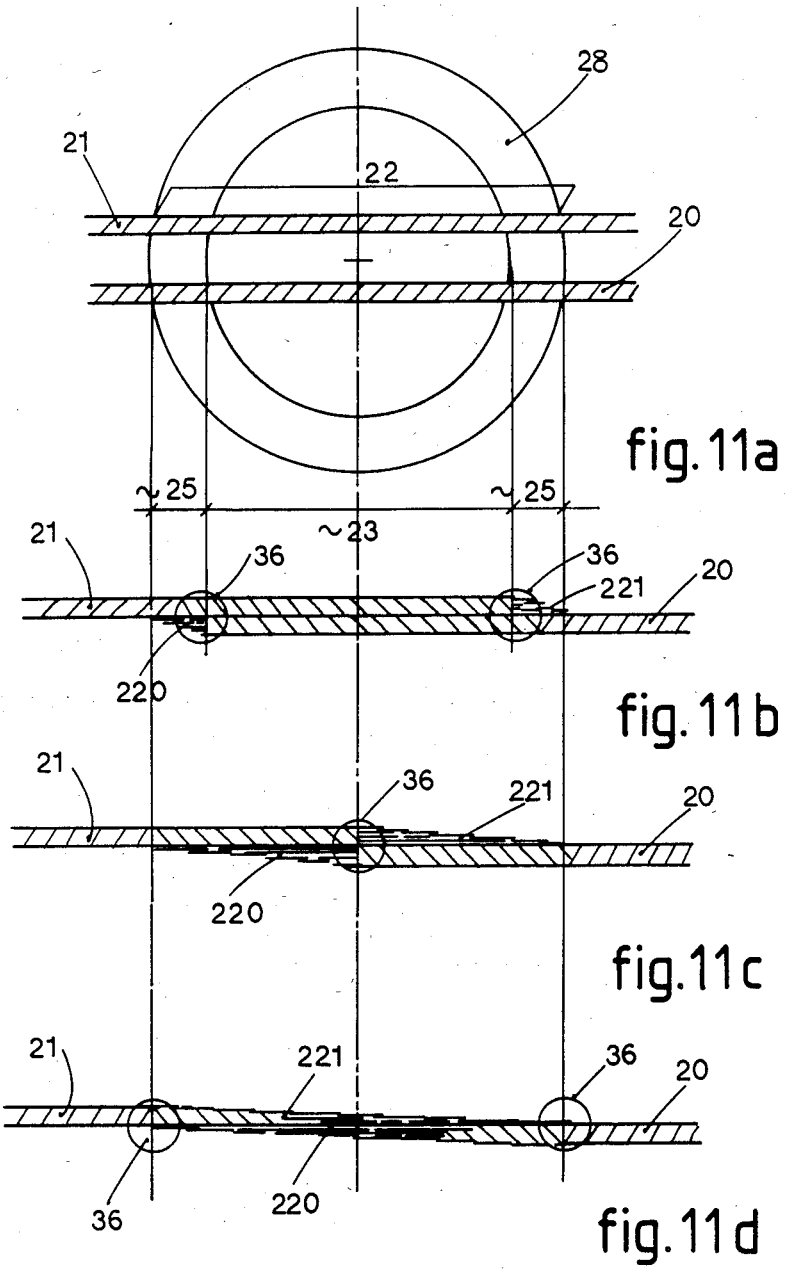

FIGS. 10 *a* and *b* show the retwisting of the prepared yarns and the obtaining of the splices;

FIGS. 11*a* and *d* show the various cases which can be obtained with the improvements of this invention.

Figures 1, 2A, 2B, 3:
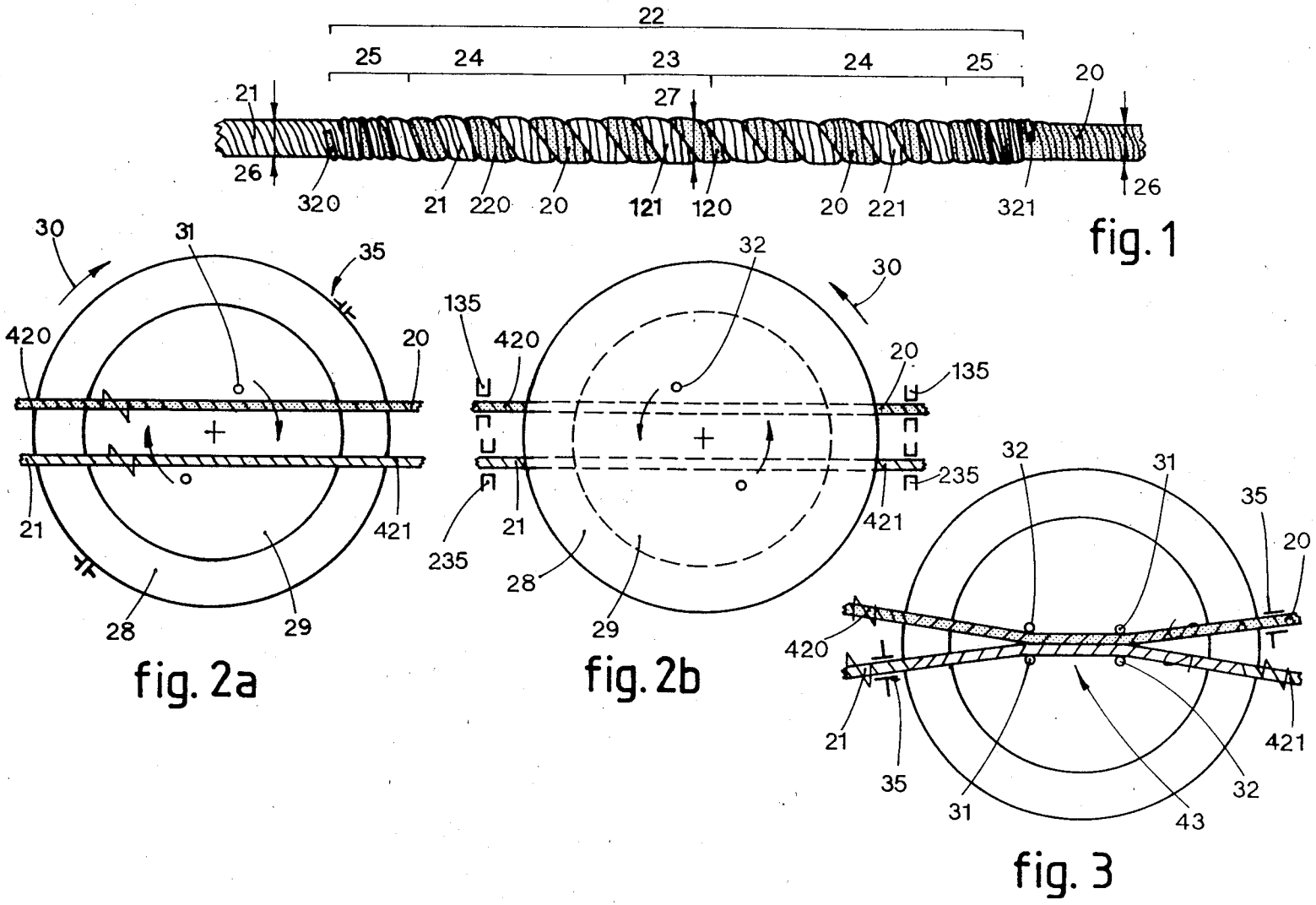
FIG. 3 shows that the untwisting action has taken place.

FIG. 1 shows a splice made according to the invention between two yarns 20 and 21 respectively which in this example possess the same characteristics.

The invention can also be applied to splices made between yarns having different characteristics.

In cases comprised between the examples of FIG. 11*b* and FIG. 11*c* the splice can have a central segment 23 in which two yarns contain segments 120 and 121 with an integral body 43.

In the segment of splice 23 with integral yarns there is therefore comprised a union between two yarn segments having mutually facing bodies which can also be integral 43, where segments 120-121 of the yarns corresponding to the segments 43 can also not be tapered but may have the same structure as the yarns 20-21 respectively.

According to the invention the segments 120-121 of the yarns may, however, have reduced fibers and the segments 43 may have reduced fibres or tapered fibers or have a combination of one or the other.

At the sides of the segment 23 there are respectively two segments of a splice between a yarn and a tail 24, in which the yarns 20 and 21 are spliced with tails 221 and 220 respectively.

At the ends of the splice 22 there are end segments 25 of the splice where the yarns 20-21 are spliced respectively with end parts 321 and 320 of the tails 221 and 220.

The end segments 25 have a feature different from the segments 24 in that the end parts 320-321 of the tails 220-221 are wound so as to bond together the yarns 21-20 respectively.

In a variant which coincides with the condition of FIG. 11*d* the central segment 23 does not exist and the segments 24 are one whole since the tails are coupled along the whole splice 22, the tails (of FIG. 11*d*) being substantially as long as the diameters of the retwisting rings 28.

Besides these extreme examples, however, all the types of splice can be obtained which are provided by the embodiment of the extreme cases shown in the examples of FIGS. 11*b* and 11*c*.

Let us now see below how these parts are obtained. With the splice 22 obtained with the proposed improvements the various parts are well bonded together and amalgamated without any excrescences and without free fibers apart from the normal hairiness of the yarn, with a regular and desired conformation.

The splice is also very compact and stable with a required density which may be homogeneous or may decrease towards its ends, thus providing the splice with a considerable resilience and capacity to absorb tensions and tearings without being impaired thereby.

Moreover, the bond established by the zones 25 creates a very stable transition zone which cannot be found with normal means nor be detected even with the most exacting normal textile operations.

Furthermore, owing to the proceudre itself the splice may have either a section 27 of splice 22 smaller than (owing either to greater compaction or to a reduction of the fibers or to the tapered part of tail reaching such zone or extending beyond it or to one or another combination of such possibilities), or substantially the same as, the section 26 of the yarns 20-21.

The invention arranges for the yarns 20-21 to be placed between two facing retwisting means 29.

The yarns 20-21 can equally well be positioned parallel or crossed over each other in the neighborhood of the axis of rotation of the retwisting means 29.

The retwisting means 29 cooperate with retwisting rings 28, and both of them can have any surface conformation, this being unimportant for the purposes of this description.

During the untwisting step (FIG. 2) the retwisting means 29 rotate, for instance, according to the arrow 30, whereas they rotate during the retwisting step (FIG. 10) according to the arrow 130.

As an example let us assume that yarns 20-21 are being processed which normally have a "Z" twist, but it would also be possible to process yarns having "S" twists or false twists.

As an example once more, the device shown with a diagram to illustrate the improved procedure comprises, inside the retwisting means 29 and in a required position, two coupling means 31 on one retwisting means 29 and two coupling means 32 on the opposite retwisting means 29.

The coupling means 31-32 are located advantageously alternated and staggered as shown in FIGS. 2*a* and *b*.

Such coupling means 31-32 are shown as being stationary on the retwisting means 29 but can also be able to move axially and/or laterally and also to perform other functions, as we shall see later.

Outer clamping means 35, plucking and tearing grippers 38 and clamping and drawing means 135-235 are provided at the periphery of the retwisting rings 28 in a desired position.

The clamping and drawing means 135-235 can be independent of each other or be one single clamping means able to perform the functions of the two single means 135-235.

If the clamping and drawing means 135-235 are provided, they take part only with the function of drawing according to this invention.

Grippers 33 to balance twists and possible abutments 37 are provided in cooperation with the plucking and tearing grippers 38.

Next, comb means 34 and inner clamping means 36 are provided within the retwisting means 29. The inner clamping means 36 may be incorporated within the coordinated action of the coupling means 31-32.

The inner clamping means 36 can act in a central position and affect a segment of yarn 43 which can vary between 3 and 40 diameters, for instance.

According to the invention the inner clamping means 36 can be positioned at any substantially diametral position located between the neighborhood of the inside of the retwisting ring 28 and the neighborhood of the outside of that retwisting ring, such latter neighborhood being located in a diametrically opposite position to the neighborhood of the inside of the retwisting ring 28.

There will be one of such means 36 per yarn, and these means 36 will work in such a way as to permit the plucking and/or tearing action which leads to the formation of small tails 220 and 221.

The means 36 can be incorporated in one single means when segments 43 are envisaged as being common to the two yarns with integral or refined fibers.

The coupling means 31-32 will be located in a position coordinated with the inner clamping means 36 and can advantageously possess either a desired resilient thrust or a successive closure movement.

The abutment means 37 can be omitted if the grippers 33 carry out a radial action or an action which can be related to a radial action.

Having illustrated diagrammatically the device which has been taken as an example to make the following description clearer, let us now examine the procedure.

The yarns 20-21, placed between the opposed retwisting means 29 and between the coupling means 31 as in the illustrative example of FIGS. 2*a* and *b*, undergo the twisting action 30 performed by the retwisting means 29 in cooperation with the retwisting rings 28.

At the end of untwisting (FIG. 3) the position will be that in the segment of yarns 20-21 contained inside the periphery of the retwisting rings 28 the twists will be, for instance, "S" twists of a required value; instead, outside the rings 28 the original "Z" twists remain.

According to the invention, while the untwisting step lasts or at about the transient stage between "Z" twists and "S" twists, the segments of yarn being untwisted and contained inside the outer periphery of the retwisting rings 28 undergo an action of controlled drawing.

This drawing action can have a fixed value or variable value; according to a variant it can be applied resiliently.

This drawing action can be either of a type suitable only for recovery of the natural elongation of the yarn or of a type able to obtain a controlled plucking action.

In the case of controlled plucking, which entails an action of refining the count of the yarn, the drawing action can be performed so far as to cause a movement of the clamping and drawing means 135-235 that may vary from zero up to at least half of the outer diameter of the untwisting ring 28.

The controlled plucking action can be applied either to both the outer ends of each yarn 20-21 or to only one end.

At any time during its application the plucking action can be halted or reduced at least momentarily with or without at least partial restoration of such action.

As stated earlier, the controlled drawing action is performed by the clamping and drawing means 135-235 or by one or the other of such means 135-235 or by analogous means, and the drawing action can take place, after the means 135-235 have clamped the yarns 20-21, either by means of an action exerted by such means substantially along the axis of the yarn, or by means of the cooperation of a means which is analogous to the abutments 37 and which converts with its presence the drawing action into an action substantially along the axis of the yarn.

As stated before, such drawing action can be of a graduated type or of a type capable of being graduated and can obtain only an effect of recovery of the natural elongation of the yarn being untwisted or else, or possibly also, can obtain an action of controlled plucking which reduces the quantity of fibers to the required degree.

The drawing action can cease after the transient condition of conversion from "Z" to "S" twists or can persist with a desired value perhaps applied resiliently.

If such drawing action is not performed by the means 135-235 after such transient condition of conversion, yet there still persists a controlled braking action (self-drawing) applied to the re-shortening effect of the yarns, such action being exerted by the friction of the untwisting rings 28 or by other brake means which may be provided.

Moreover, in the case of long fibers the drawing action, or the drawing and plucking action, can exert also an action of controlled plucking and tearing.

Furthermore, the drawing action can take place continuously, namely without a temporary suspension of the untwisting action, or with at least a transient suspension and/or slowing of the untwisting action.

At the end of untwisting (FIG. 3) the coupling means 31-32 bring suitable segments of yarn into contact with each other.

In the case shown in the examples from FIG. 4 to FIG. 9 inclusive the segments thus brought into contact correspond advantageously to those common to the integral body 43 of the yarns 20-21; such segments 43 will form in the splice the segment of splice 23 made with integral yarns, such segments 43 being contained between the coupling means 31-32 at the end of untwisting.

Substantially at about the end of untwisting the yarns 20-21 are gripped by the outer clamping means 35, which prevent transfer of the negative twists to the segments of yarn 20-21 which are not to be torn.

The yarns 20-21 are gripped near the periphery of the retwisting rings 28 at the part where the yarns 20-21 will continue to remain integral.

Also at about the end of untwisting (FIG. 4) the yarns 20-21 are clamped at their segment 43 and at a position in the middle of such segment 43 so that the negative twists remain imparted.

Such clamping can take place either through the combined action of the coupling means 31-32 or through the action of appropriate inner clamping means 36 or through the action of other suitable means.

Such action will affect a segment which may extend, in relation to the yarn and to the effect which it is desired to obtain, from 3 to 40 diameters.

The delimitation of the segments 43 thus coincides with an action of reciprocal thrust exerted respectively by the coupling means 31-32 or by the inner clamping means 36 on the yarns 20-21.

The reciprocal thrust exerted by the means 31-32 can be of a resilient type or of a fixed type in relation to the distance at which such means 31 or 32 are positioned along the diameter.

Thus in the examples from FIG. 4 to FIG. 9, when untwisting has been carried out, the negative twists imparted cannot move either into the segments 43 (and, more particularly, into the segment 43 cooperating with the inner clamping means 36) or into the segments which go from 43 towards the periphery of the retwisting rings 28 and towards the yarns 20-21 which will remain integral.

Figure 4:
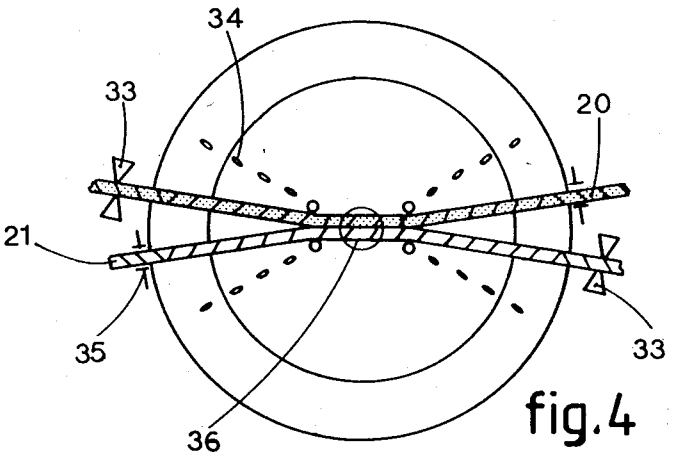
FIG. 4 shows the clamping of the yarns.
Figure 6:
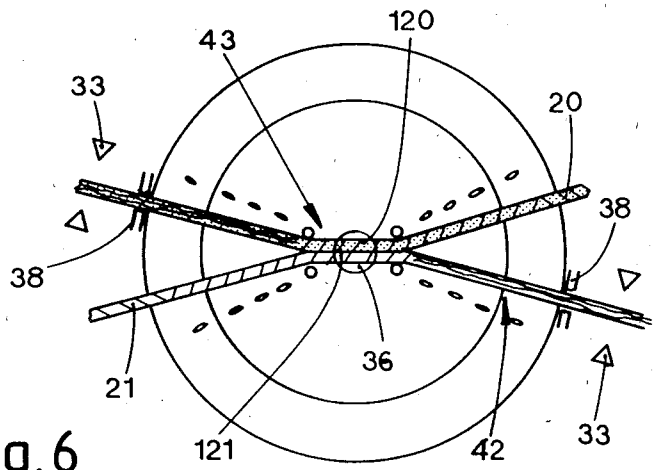
FIG. 6 shows the clamping performed to obtain the tails.
Figure 9:
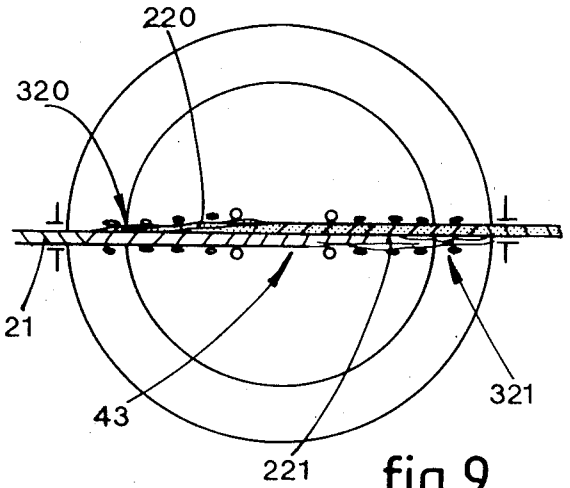
FIG. 9 shows the tapered tails brought alongside the yarns.

The tail ends 420-421 are clamped, at a moment which can be determined as required at about the end of the untwisting, by grippers 33 which balance twists and which are located at a desired distance from the periphery of the retwisting rings 28; such distance can be graduated as desired (FIG. 4).

The moment at which the grippers 33 are closed is such as to balance, at the end of untwisting, the "S" twists present in the segment which goes from the inner clamping point determined by the means 31-32 or by the means 36 towards the periphery of the retwisting rings 28, against the "Z" twists built up in the segment which runs from such periphery of the retwisting rings 28 to such grippers 33.

Figure 5:
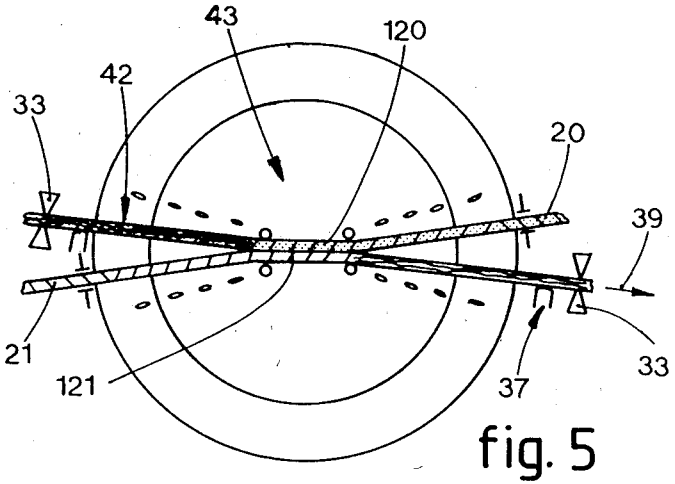
FIG. 5 shows how the fibers in the tail ends are made parallel.

When the grippers 33 have been actuated, the retwisting means 29 and retwisting rings 28 are opened slightly, and the negative twists present in the tail end 420-421 in the segment which goes from the inner clamping point determined by the means 31-32 or by the means 36 towards the periphery of the rings 28 are substantially cancelled with the twists present outside such rings 28 and between such rings 28 and the grippers 33 (FIG. 5).

So as to remove also any hysteresis in the fibers, the grippers 33 perform an action 39 to tension the tail ends, perhaps with the help of abutments 37.

Segments 42 of untwisted tail ends with substantially parallel fibers are thus obtained (FIG. 5).

Next, plucking and/or tearing grippers 38 take part and act in cooperation with the periphery of the retwisting rings 28, which clamp the untwisted parallelized tail ends 42 in the desired position.

The grippers 33 which balance twists can now open and release the tail ends 42.

The plucking and/or tearing grippers 38 now exert a plucking and/or tearing action 40 along the axis of the untwisted parallelized tail ends 42.

This action 40 is exerted in cooperation with the clamping action performed by the inner clamping means 36 or by the substitutes of the latter.

Figure 7:
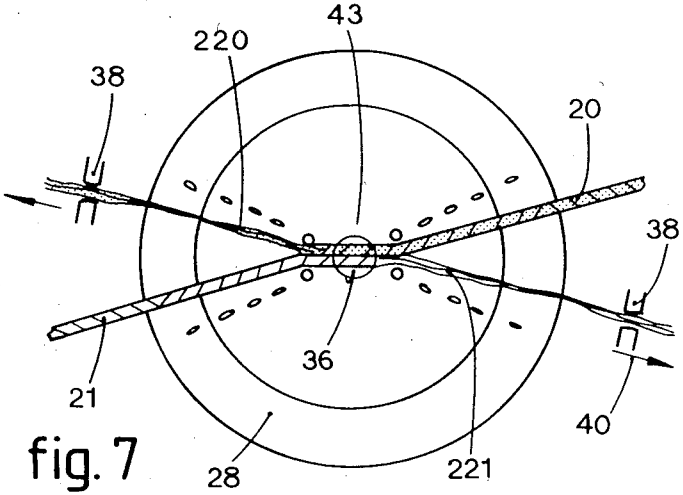
FIG. 7 shows the obtaining of tapered tails.

By exerting the action 40 on fibers which are substantially parallel it is possible to obtain a small tail which is progressive and begins at the neighborhood controlled by the periphery of the ring 28 (FIG. 7).

Such small tail 220-221 extends progressively at least to the neighborhood of the periphery of the inner clamping means 36 or of the substitutes of the latter 36 and may affect also at least part of the yarn enclosed within such inner clamping means 36.

According to the invention, in conjunction with the action 40 the means 31 or 32 or both of them can release the yarns slightly and can then re-clamp, or clamp, the yarns at about the time of the action 40 or soon after the end of the action 40.

The tails 220-221 thus have their fibers substantially parallel and a tapered form, the whole being controlled even as regards the quantity of fibers.

After the plucking and/or tearing action 40 or in cooperation with the same 40 the comb means 34 intervene according to 41 with a closure (FIG. 8), thus bringing the fibers of the small tails 220-221 into contact respectively against the yarns 21-20 (FIG. 9) with an action of controlled approach.

Figure 10B:
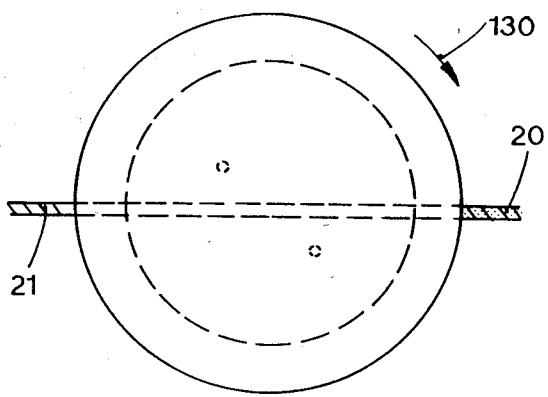
Figure 8:
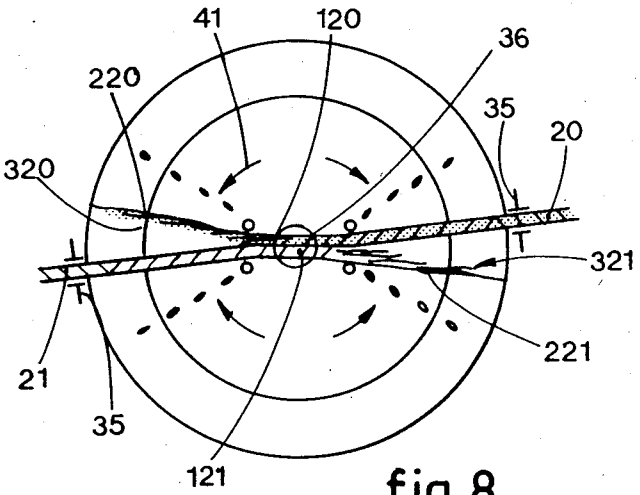
FIG. 8 shows the lateral control of the tails.
Figure 10A:
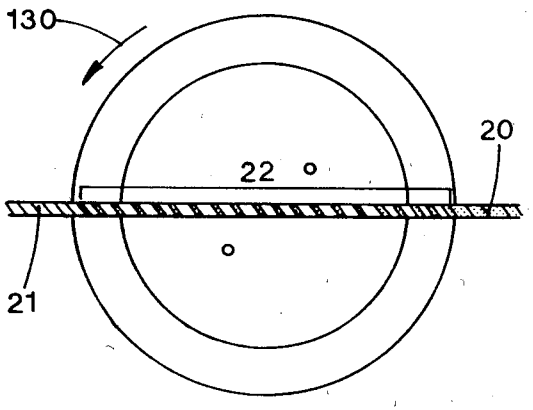

At about this moment the retwisting means 29 and retwisting rings 28 approach one another once again and then rotate in opposite directions to each other 130 so as to re-impart the desired twists (FIGS. 10*a* and 10*b*).

The comb means 34 are retracted at about the beginning of rotation.

With the improvements proposed a continuous control and dosage of the yarns, fibers, action exerted on the yarns and fibers and of the transient and final effects are therefore obtained.

We claim:

1. In a process for splicing yarns involving coupling two single yarns having portions each bearing a twist of a sign opposite the sign of the original twist and thereafter reimparting the original twist to the yarn portions, said process comprising (a) providing two single yarns, (b) untwisting a portion of each of said two single yarns until there results a twist having a sign opposite to the sign of the original twist, (c) placing the fibers of said yarns in substantially parallel array, (d) subjecting the substantially parallel fibers to a plucking and/or tearing action along the axis of said yarns, to form tails having a taper, (e) positioning said tails along said yarns, (f) coupling said yarns, and (g) retwisting the coupled yarns at the untwisted portions to form a desired twist, the improvement comprising subjecting at least that portion of said yarns that is untwisted to drawing during at least the untwisting step (b) and at least at about the transient stage of conversion from one type of twist to the twist of the opposite sign.

2. The process of claim 1 wherein said yarns are changed from a Z twist to a S twist.

3. The process of claim 1 wherein said yarns are changed from an S twist to a Z twist.

4. The process of claim 1 wherein drawing is carried out substantially along the axis of the yarns at the portion being untwisted.

5. The process of claim 4 wherein drawing at least recovers the natural elongation of the yarn being untwisted.

6. The process of claim 1 wherein drawing at least recovers the natural elongation of the yarn being untwisted.

7. The process of claim 6, wherein, in addition to recovering the natural elongation, the drawing exerts a plucking action at least up to a value of about 50% of the length of the final splice.

8. The process of claim 1 wherein the drawing is an adjustable-type drawing.

9. The process of claim 1 wherein the drawing is a variable drawing.

10. The process of claim 1 wherein the drawing is a continuous drawing.

11. The process of claim 1 wherein the drawing causes a plucking action in at least one segment of the segment of yarn being untwisted.

12. The process of claim 1 wherein the drawing causes an at least partial tearing of at least part of the fibers.

13. The process of claim 1 wherein the drawing causes an at least partial plucking which conditions the quantity of fibers present at least in one segment of the segment of yarn being untwisted.

14. The process of claim 1 wherein the drawing takes place while untwisting continues.

15. The process of claim 1 wherein at least part of the drawing takes place at about at least one momentary halt in the untwisting step.

16. The process of claim 1 wherein said yarns are at least momentarily clamped in a clamping zone substantially near to and within the periphery of the coupling and retwisting zones.

17. The process of claim 1 wherein said yarns are at least momentarily clamped in a clamping zone substantially near to and outside the periphery of the coupling and retwisting zones.

18. The process of claim 1 wherein said yarns are at least momentarily clamped at a location substantially diametrically within the coupling and retwisting zones.

19. The process of claim 1 wherein said plucking and/or tearing action results in the formation of tails that begin in the neighborhood of the periphery of a zone wherein said yarns can be subjected to clamping.

20. The process of claim 1 wherein said plucking and/or tearing action results in the formation of tails that begin inside a zone wherein said yarns can be subjected to clamping.

21. The process of claim 1 wherein said yarns are clamped and clamping is slackened slightly during said plucking and/or tearing action.

22. The process of claim 1 wherein said yarns are clamped and clamping is at least renewed toward the end of said plucking and/or tearing action.

23. The process of claim 1 wherein the drawing is braked after the occurrence of the transient stage between one type of twist to the twist of the opposite sign.

* * * * *